US010494233B2

(12) United States Patent
Sturm, Jr.

(10) Patent No.: US 10,494,233 B2
(45) Date of Patent: Dec. 3, 2019

(54) RELOCATABLE FINE MOTION POSITIONER ASSEMBLY ON AN OVERHEAD CRANE

(71) Applicant: PaR Systems, Inc., Shoreview, MN (US)

(72) Inventor: Albert J. Sturm, Jr., Stillwater, MN (US)

(73) Assignee: PaR Systems, LLC, Shoreview, MN (US)

( * ) Notice: Subject to any disclaimer, the term of this patent is extended or adjusted under 35 U.S.C. 154(b) by 949 days.

(21) Appl. No.: 14/766,367

(22) PCT Filed: Nov. 27, 2013

(86) PCT No.: PCT/US2013/072314
§ 371 (c)(1),
(2) Date: Aug. 6, 2015

(87) PCT Pub. No.: WO2014/123607
PCT Pub. Date: Aug. 14, 2014

(65) Prior Publication Data

US 2015/0368074 A1 Dec. 24, 2015

Related U.S. Application Data

(63) Continuation-in-part of application No. 13/760,548, filed on Feb. 6, 2013, now abandoned.

(51) Int. Cl.

| | |
|---|---|
| ***B66C 13/08*** | (2006.01) |
| ***B66C 17/00*** | (2006.01) |
| ***B66C 13/06*** | (2006.01) |

(52) U.S. Cl.
CPC ..... *B66C 13/08* (2013.01); *B66C 13/06* (2013.01); *B66C 17/00* (2013.01)

(58) Field of Classification Search
CPC .... B66C 1/00; B66C 1/14; B66C 1/16; B66C 1/68; B66C 11/12; B66C 13/04;
(Continued)

(56) References Cited

U.S. PATENT DOCUMENTS

| | | | |
|---|---|---|---|
| 300,344 | A | 6/1884 | Chamblin et al. |
| 655,367 | A | 8/1900 | Morgan |

(Continued)

FOREIGN PATENT DOCUMENTS

| | | | |
|---|---|---|---|
| DE | 2115587 | | 10/1972 |
| DE | 3639651 | A1 | 6/1988 |

(Continued)

OTHER PUBLICATIONS espacenet.com translation of FR 2,085,267 A1 (Year: 2015).*

(Continued)

*Primary Examiner* — Sang K Kim
*Assistant Examiner* — Nathaniel L Adams
(74) *Attorney, Agent, or Firm* — Steven M. Koehler; Westman, Champlin, Koehler, P.A.

(57) ABSTRACT

A method and apparatus is provided for at least holding an object with a crane having a bridge spanning between and movable on the spaced apart rails, an upper platform movable longitudinally on the bridge, and a hoist mounted to the platform, the hoist having a rope and a lifting member disposed at a remote end of the rope. The method includes engaging and moving a positioner to a selected location on the bridge or the upper platform using the hoist; securing the positioner to the bridge at the selected location or the upper platform; securing the positioner to an object; holding the object with the positioner; releasing the object from the positioner; releasing the positioner from the bridge or the
(Continued)

upper platform; and engaging and moving the positioner away from the selected location on the bridge or the upper platform using the hoist.

21 Claims, 11 Drawing Sheets

(58) Field of Classification Search
CPC ..... B66C 13/06; B66C 13/08; B66C 17/00; B66C 17/06; B66C 17/26; B66C 19/00; B66C 2700/017
USPC ..... 212/316, 319, 326, 327
See application file for complete search history.

(56) References Cited

U.S. PATENT DOCUMENTS

| | | | |
|---|---|---|---|
| 1,419,129 | A | 6/1922 | Fitch |
| 2,164,128 | A | 6/1939 | Medenwald |
| 2,720,327 | A | 10/1955 | Bain |
| 2,752,120 | A | 6/1956 | Bogle |
| 2,869,734 | A | 1/1959 | Ernestus |
| 2,973,942 | A | 3/1961 | Schaper |
| 3,051,321 | A | 8/1962 | Ramsden |
| 3,104,016 | A | 9/1963 | Harry |
| 3,247,974 | A | 4/1966 | Dechantsreiter |
| 3,276,602 | A | 10/1966 | Vogeley |
| 3,476,263 | A | 11/1969 | Komatsu et al. |
| 3,567,040 | A | 3/1971 | Thomson |
| 3,671,069 | A | 6/1972 | Martin et al. |
| 3,743,107 | A | 7/1973 | Verschoof |
| 3,768,664 | A | 10/1973 | Bauer |
| 3,825,128 | A | 7/1974 | Cooper |
| 3,842,986 | A | 10/1974 | Hupkes |
| 3,874,513 | A | 4/1975 | Wilson |
| 3,874,514 | A | 4/1975 | Wilson |
| 3,887,080 | A | 6/1975 | Wilson |
| 3,899,083 | A | 8/1975 | Flessner |
| 3,971,478 | A | 7/1976 | Matasa |
| 4,057,942 | A | 11/1977 | Kranefeld |
| 4,076,127 | A | 2/1978 | Hupkes |
| 4,133,514 | A | 1/1979 | Anderson |
| 4,142,710 | A | 3/1979 | Okuda |
| 4,158,414 | A | 6/1979 | Wilson |
| 4,360,112 | A | 11/1982 | Brewer |
| 4,687,110 | A | 8/1987 | Partanen et al. |
| 4,761,112 | A | 8/1988 | Hammon et al. |
| 4,883,184 | A | 11/1989 | Albus |
| 4,949,855 | A | 8/1990 | Foit |
| 4,953,721 | A | 9/1990 | Foit |
| 5,150,799 | A | 9/1992 | Long, Jr. |
| 5,257,891 | A | 11/1993 | Baumann |
| 5,489,033 | A | 2/1996 | Luebke |
| 5,507,596 | A | 4/1996 | Bostelman et al. |
| 5,628,416 | A | 5/1997 | Frommelt |
| 5,765,703 | A | 6/1998 | Shiwaku |
| 5,819,962 | A | 10/1998 | Okubo et al. |
| 6,023,862 | A | 2/2000 | Sirjola |
| 6,126,023 | A | 10/2000 | Durrant-Whyte et al. |
| 6,182,843 | B1 | 2/2001 | Tax |
| 6,216,895 | B1 | 4/2001 | Erdmann |
| 6,343,702 | B1 | 2/2002 | Masumoto et al. |
| 6,374,147 | B1 | 4/2002 | Rockwood |
| 6,439,407 | B1 | 8/2002 | Jacoff et al. |
| 6,474,486 | B1 | 11/2002 | Baraniak |
| 6,566,834 | B1 | 5/2003 | Albus et al. |
| 6,644,486 | B2 | 11/2003 | Jacoff et al. |
| 6,826,452 | B1 | 11/2004 | Holland et al. |
| 6,827,334 | B2 | 12/2004 | Volle |
| 7,284,744 | B1 | 7/2007 | Lerchenmueller et al. |
| 7,287,740 | B2 | 10/2007 | Reyes et al. |
| 7,392,914 | B2 | 7/2008 | Sorsa |
| 7,575,214 | B2 | 8/2009 | Badalament |
| 7,896,324 | B2 | 3/2011 | Okazaki |
| 8,195,368 | B1 | 6/2012 | Leban et al. |
| 8,646,630 | B2 | 2/2014 | Franzen et al. |
| 2002/0144967 | A1 | 10/2002 | Jacoff |
| 2004/0146388 | A1 | 7/2004 | Khajepour |
| 2005/0024004 | A1 | 2/2005 | Rodnunsky |
| 2005/0024005 | A1 | 2/2005 | Rodnunsky et al. |
| 2005/0224438 | A1 | 10/2005 | Maurer |
| 2007/0064208 | A1 | 3/2007 | Giegerich et al. |
| 2007/0114505 | A1 | 5/2007 | Reyes |
| 2008/0121601 | A1 | 5/2008 | Ehrenleitner |
| 2009/0066100 | A1 | 3/2009 | Bosscher et al. |
| 2009/0159548 | A1 | 7/2009 | Waisanen |
| 2013/0126457 | A1 | 5/2013 | Sturm |

FOREIGN PATENT DOCUMENTS

| | | | | |
|---|---|---|---|---|
| DE | 102005030969 | | 12/2001 | |
| DE | 10245868 | | 4/2004 | |
| FR | 2085267 | A1 | 12/1971 | |
| FR | 2085267 | A1 * | 12/1971 | ..... B66C 13/06 |
| JP | 47030457 | U | 12/1972 | |
| JP | 64013395 | A | 1/1989 | |
| JP | 03100279 | U | 10/1991 | |
| JP | 05019280 | U | 3/1993 | |
| JP | H07 33384 | A | 2/1995 | |
| JP | H07 61766 | A | 3/1995 | |
| JP | 2004075233 | A | 3/2004 | |
| JP | 2004155580 | A | 6/2004 | |
| NL | 7203224 | | 10/1972 | |
| SU | 1157007 | A1 | 5/1985 | |
| WO | 2005013195 | A2 | 2/2005 | |
| WO | WO 2007/139383 | | 12/2007 | |
| WO | 2011123816 | A2 | 10/2011 | |

OTHER PUBLICATIONS

Ukrainian Office Action dated Jul. 7, 2014 for corresponding Ukrainian Application No. a 2012 12292, filed Apr. 1, 2011.

European Search Report dated Jun. 25, 2014 for corresponding European Application No. 14157697, filed Apr. 1, 2011.

European Search Report of the European Patent Office in foreign application No. PCT/US2011/030995 filed Apr. 1, 2011, dated Sep. 5, 2012.

U.S. Office Action dated May 27, 2015 for corresponding U.S. Appl. No. 13/760,548, filed Feb. 6, 2013.

U.S. Appl. No. 13/078,801, filed Apr. 1, 2011.

International Search Report and Written opinion dated Feb. 21, 2014 for corresponding International Patent application No. PCT/US2013/072314 filed on Nov. 27, 2013.

* cited by examiner

RELOCATABLE FINE MOTION POSITIONER ASSEMBLY ON AN OVERHEAD CRANE

CROSS-REFERENCE TO RELATED APPLICATION

This Application is a Section 371 National Stage Application of International Application No. PCT/US2013/072314, filed Nov. 27, 2013, and published as WO2014/123607 on Aug. 14, 2014, in English, which is a continuation-in-part and claims priority of the U.S. application Ser. No. 13/760,548, filed on Feb. 6, 2013, the contents of which are hereby incorporated by reference in their entirety.

BACKGROUND

Overhead cranes are well known and are used frequently to lift and carry objects from one portion of a work bay to another. The crane commonly employs a single hoist that provides a lifting hook or other fixture used to carry the object. At least one and in some cases a plurality of vertically extending wire ropes support the lifting fixture where sheaves provided on the lifting fixture and proximate the hoist can be used to increase lifting capacity of the crane.

Although such cranes are well suited for lifting and carrying objects, such cranes do not allow accurate positioning of the object without help from additional devices or human operators since the wire rope(s) extend vertically. Performing work on the object when supported by the crane is typically not practical because the vertically extending wire rope(s) provide little if any ability to resist lateral loads and/or overturning moments such as a moment about the vertically extending wire rope(s), or about other axes orthogonal to the wire rope(s) depending upon the point of attachment to the object.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the background.

The aspects described below are to various inventive aspects of a detachable and relocatable positioner on an overhead crane as well as a crane assembly including the same, and a method of operation regarding the same. These aspects need not be present on every system, or method but rather can be combined in any manner or used alone as desired.

A first aspect comprises a crane system having a pair of opposed rails and a bridge spanning between and supported on the rails and movable thereon. An upper platform is movable longitudinally on the bridge and carries a hoist. The hoist includes a rope and a lifting member disposed at a remote end of the rope. The crane system further includes a positioner. The positioner includes a frame with a lift point selectively engageable by the lifting member. A reference vertical axis extends through the frame. A plurality of hoists is mounted to the frame. Each hoist has at least one rope. The ropes from the hoists extend downwardly and inwardly to the vertical axis from spaced apart locations about the frame. The ropes are joined to and support a lower member at spaced apart locations about the lower member. One or more locking devices are configured to selectively secure the positioner to at least one of the upper platform or the bridge.

The crane system can include one or more of the following features. In particular, the one or more locking devices can be configured to completely detach the positioner from the bridge or the upper platform, or detach in a manner so that the positioner can be moved to a different location on the bridge while remaining in contact with and being supported by at least in part by the bridge.

If desired the positioner and the bridge or upper platform can include one or more contact or non-contacting aligning devices comprising a first element disposed on the bridge or upper platform and a second element on the frame that is alignable with the first element and configured to locate a fixed position for the positioner on the bridge or upper platform. In a further embodiment, a plurality of spaced apart first elements can be disposed on the bridge or upper platform each alignable with the second element on the frame.

In one embodiment, the lift point is at least proximate a center of gravity for the positioner and is configured to be moved away from the center of gravity to allow the lift member to extend downwardly through a recess in the frame of the positioner. The recess can comprise an upper channel also of size to receive the lift member. The upper channel includes an opening at a location on an outer perimeter of the frame. The opening of the upper channel is oriented such that the rope can traverse the channel with movement of the hoist on the bridge, while the rope extends through the positioner. Likewise, the lower member can include a lower channel that is aligned with the upper channel allowing the rope and lifting member to extend through the lower channel.

The locking devices can comprise a clamp or other suitable fastener. The locking devices can engage a lower horizontal flange on the bridge or upper platform such as the opposed horizontally extending flanges on an I-beam or support plate. However, on other bridges or portions of the upper platform such as those formed as an elongated box section, support(s) and/or other modifications, for example, aperture(s) can be formed on the bridge or upper platform to which the positioner can be attached when desired. If desired, the support(s) can extend continuously along the longitudinal length of the bridge.

A fixture can be provided and configured to hold the positioner when in storage. The fixture can be located in a position or be movable to a position such that the lifting member of the hoist engages the lift point on the frame.

Another aspect is a method for at least holding an object with a crane having a bridge spanning between and movable on the spaced apart rails, an upper platform movable longitudinally on the bridge, and a hoist mounted to the platform, the hoist having a rope and a lifting member disposed at a remote end of the rope. The method includes engaging and moving a positioner to a selected location on the bridge or the upper platform using the hoist. For the inventive method, the positioner need not be of the type described above, but in an advantageous embodiment can be. The positioner is secured to the bridge at the selected location or the upper platform. The positioner can then be secured or otherwise fastened to an object at which point the positioner can be used to hold the object with the positioner for purposes such as fabrication, assembly and/or inspection. The positioner can also be used to accurately position the object as desired.

Upon completion of the task with the object, the object is released from the positioner and the hoist engages the positioner. Typically, the positioner is then released from the bridge or upper platform such that the hoist can move the positioner away from the selected location on the bridge or the upper platform.

The method can further include holding the positioner in a fixture spaced apart from the bridge prior to engaging and moving the positioner to the selected location on the bridge or upper platform, and wherein engaging and moving the positioner to the selected location or upper platform includes lifting the positioner with the hoist from the fixture, and wherein moving the positioner away from the selected location on the bridge or upper platform includes lowering the positioner on the fixture, and wherein the method further comprises releasing the positioner from the hoist.

If desired, the positioner and the bridge or upper platform can include one or more aligning devices comprising a first element disposed on the bridge or upper platform and a second element on the frame that is alignable with the first element at the selected location, and wherein engaging and moving a positioner to a selected location on the bridge or upper platform using the hoist includes moving the positioner until the first and second elements are aligned.

The method can further include lifting an object with the hoist and moving the object to a position below the positioner when the positioner is secured to the bridge at the selected location. In one embodiment, the positioner includes a channel having an opening and wherein moving the object to a position below the positioner when the positioner is secured to the bridge at the selected location includes moving the rope through the channel and through an opening provided on an outer perimeter edge of the positioner. In yet a further embodiment, moving the object includes moving the upper platform to a position above the positioner.

DETAILED DESCRIPTION OF ILLUSTRATIVE EMBODIMENT

Figure 1:
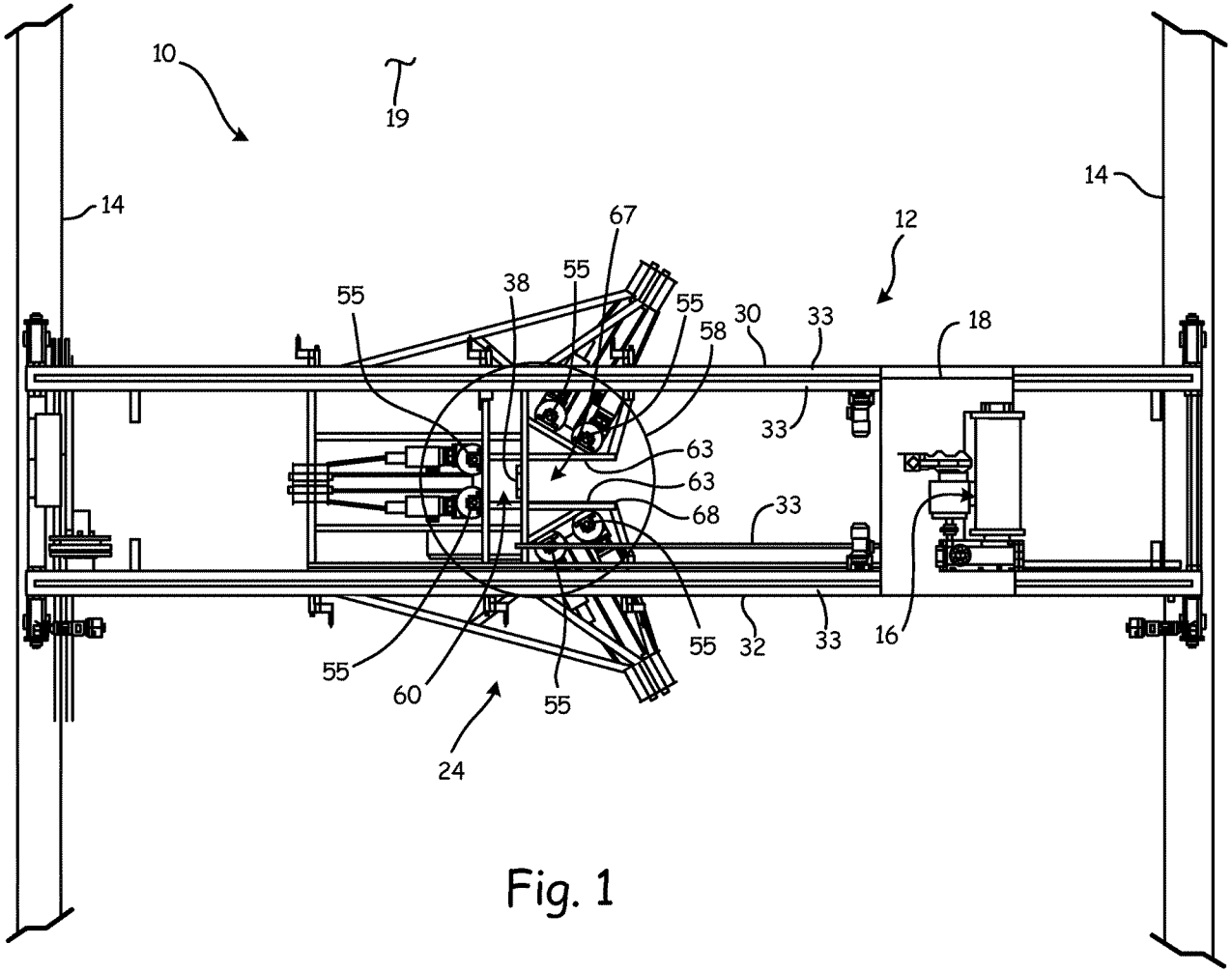
FIG. 1 is a top plan view of a first embodiment of a crane system.

The embodiment described below and illustrated in the accompanying figures describe various inventive aspects of a detachable and relocatable positioner on an overhead crane as well as a crane assembly including the same, and a method of operation regarding the same. Although these aspects are described and in illustrated with respect to the exemplary embodiment, it should be understood that all the aspects need not be present on every system, but rather can be combined in any manner or used alone as desired.

Referring to the figures, an overhead crane is illustrated at 10 and in the embodiment illustrated comprises a gantry crane having a bridge 12 moveable on opposed rails 14. A hoist 16 is mounted to an upper platform 18 that in turn is selectively positionable on the bridge 12 thereby creating a work envelope 19 extending between and along the rails 14 and with a height equal to the distance of lift provided by the hoist 16. Although the crane system 10 is well suited for carrying and lifting objects, such cranes are unable to position, orient and/or hold the object with precision necessary for some fabricating and/or assembly needs.

A relocatable and/or detachable positioner is illustrated at 24. Generally, the positioner 24 is moveable to a desired position on the bridge 12 by the hoist 16 and the upper platform 18. After obtaining the desired position on the bridge 12, the positioner 24 is secured to the bridge 12 or the hoist 16 (e.g. upper platform 18), but in a releasable manner. In an embodiment where the positioner 24 is secured to the bridge 12, after securing the positioner 24 to the bridge 12, the hoist 16 can be detached from the positioner 24 and used, for example, to lift and carry objects in at least some of the work envelope 19, and in an a particularly advantageous embodiment, to lift and carry an object to a position below the positioner 12 where the positioner 24 can then be attached to the object and be used to accurately position, orient and/or securely hold the object as needed.

In a first illustrated embodiment, the bridge 12 includes two parallel support members 30, 32 upon which the upper platform 18 can be guided on for example using linear bearings or other suitable guides. Likewise, the bridge 12 can be guided on each of the support rails 14 with linear bearings or other suitable guides. Movement of the platform 18 on the bridge 12 as well as the bridge 12 upon the rails 14 is all that is needed for understanding aspects of the present invention. Mechanisms for accomplishing such movements (e.g. hydraulic and/or electric motors carried by the bridge 12 or platform 18 engaging linear gear racks on the rails 14 and bridge 12) are well known to those skilled in the art and can take any number of forms. It should also be noted that the bridge 12 need not comprise two parallel support members 30,32 wherein a single support member spanning between the rails 14 may be sufficient in some embodiments.

Figure 2:
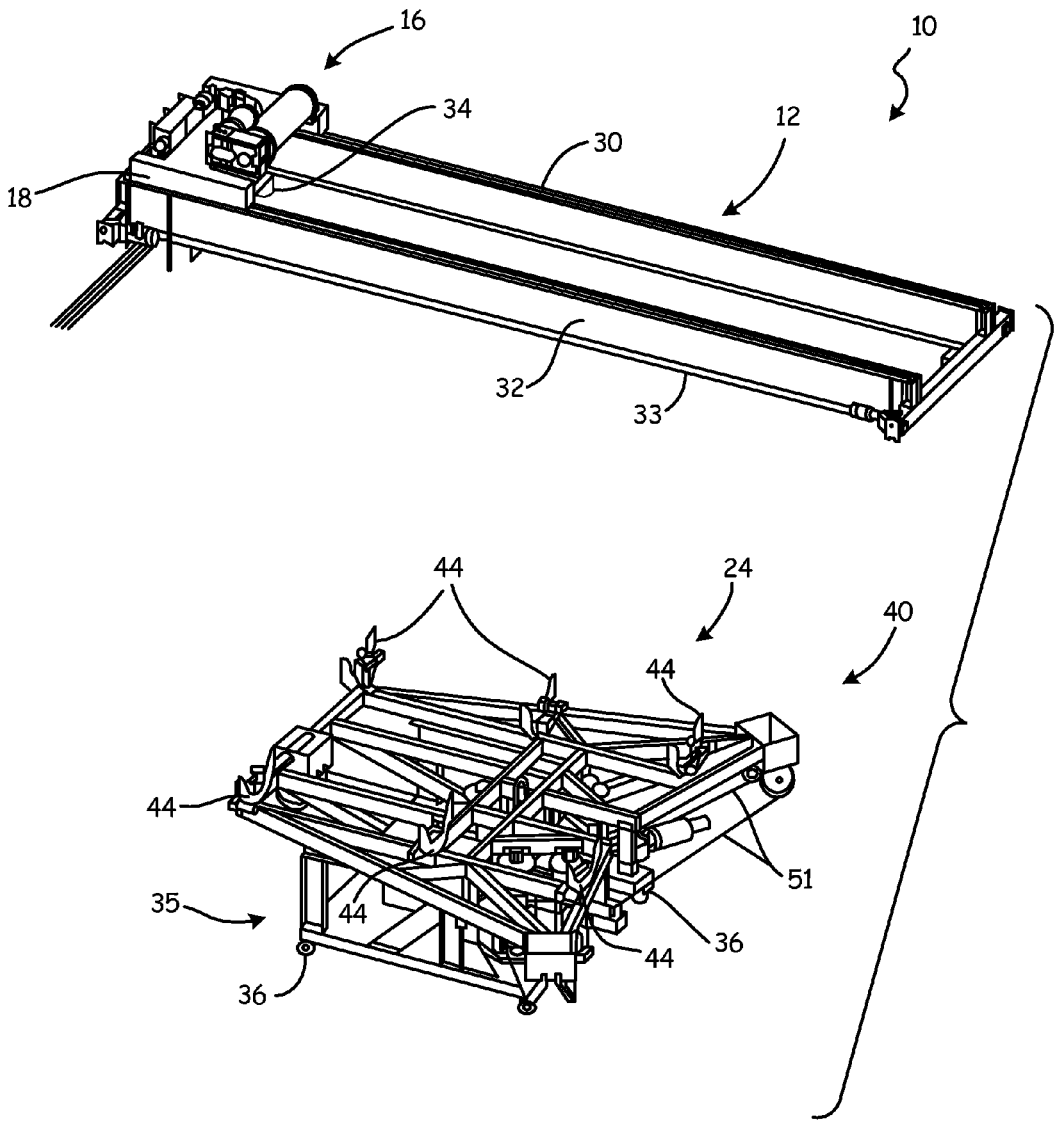
FIGS. 2-9 are perspective views of the crane system of FIG. 1 with elements in various positions.
Figure 3:
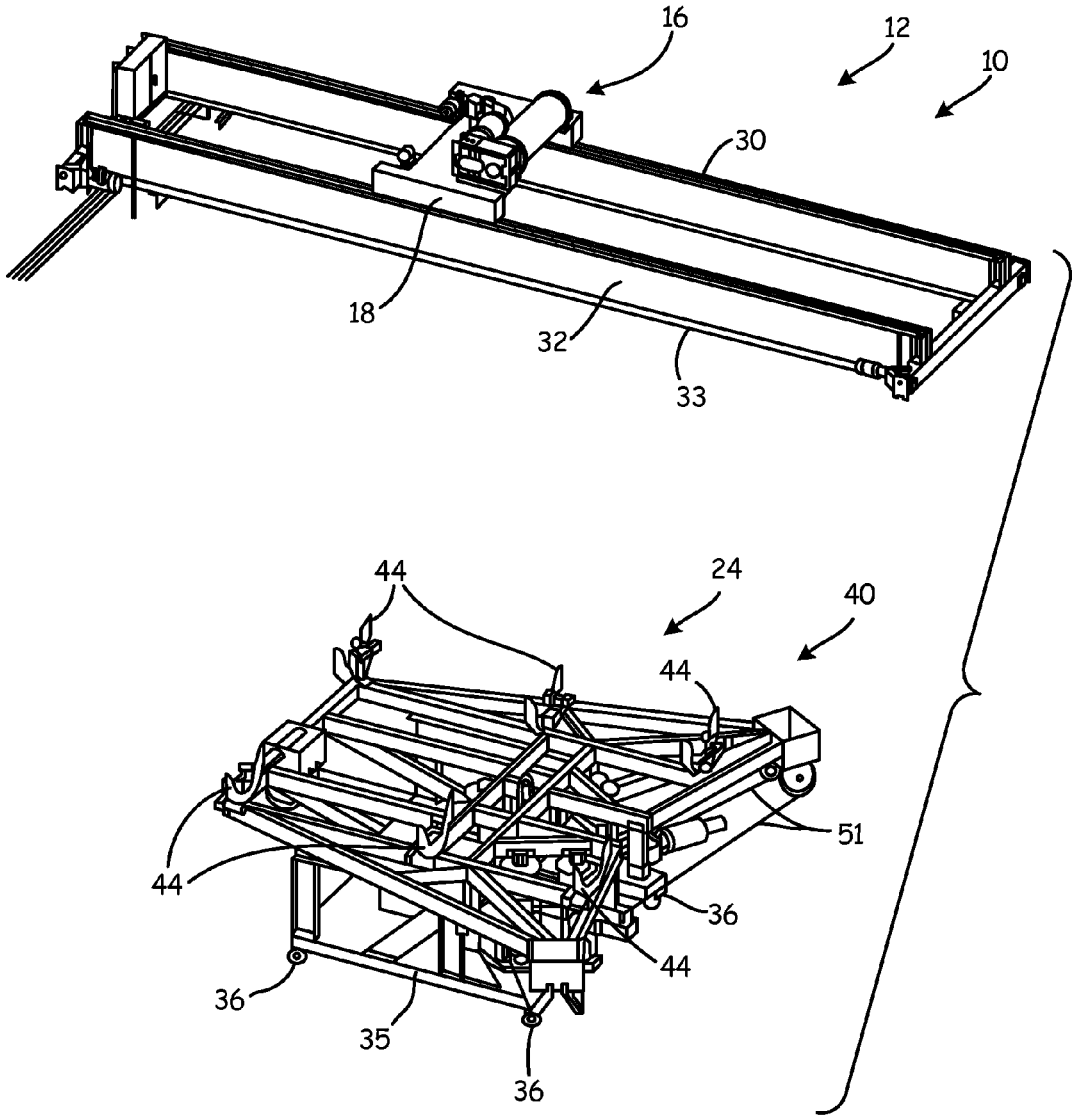

Referring to FIG. 2, in one embodiment, the positioner 24 can be held in a holding fixture 35 when not in use. When it is desired to mount the positioner 24 to the bridge 12 or the hoist 16, the crane 10 is operated so as to position a lifting member such as a carrying hook 34 or the like of the hoist 16 over the positioner 24. It should be noted that the holding fixture 35 can be located in a stationary position, or if desired, can include wheels 36 so as to allow the positioner 24/holding fixture 35 to be located at a convenient location for attachment to the hoist 16 and then returned to another location for storage when not in use.

Figure 4:
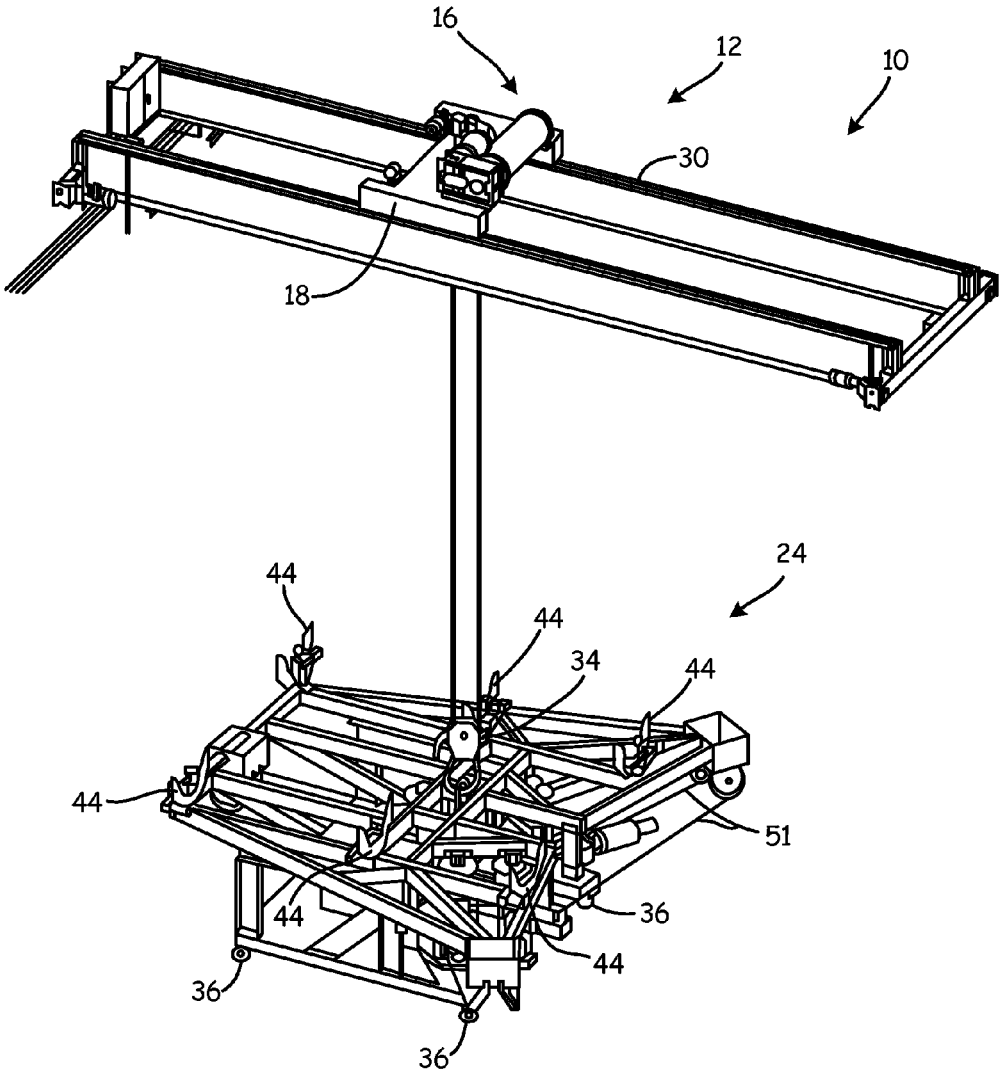
Figure 5:
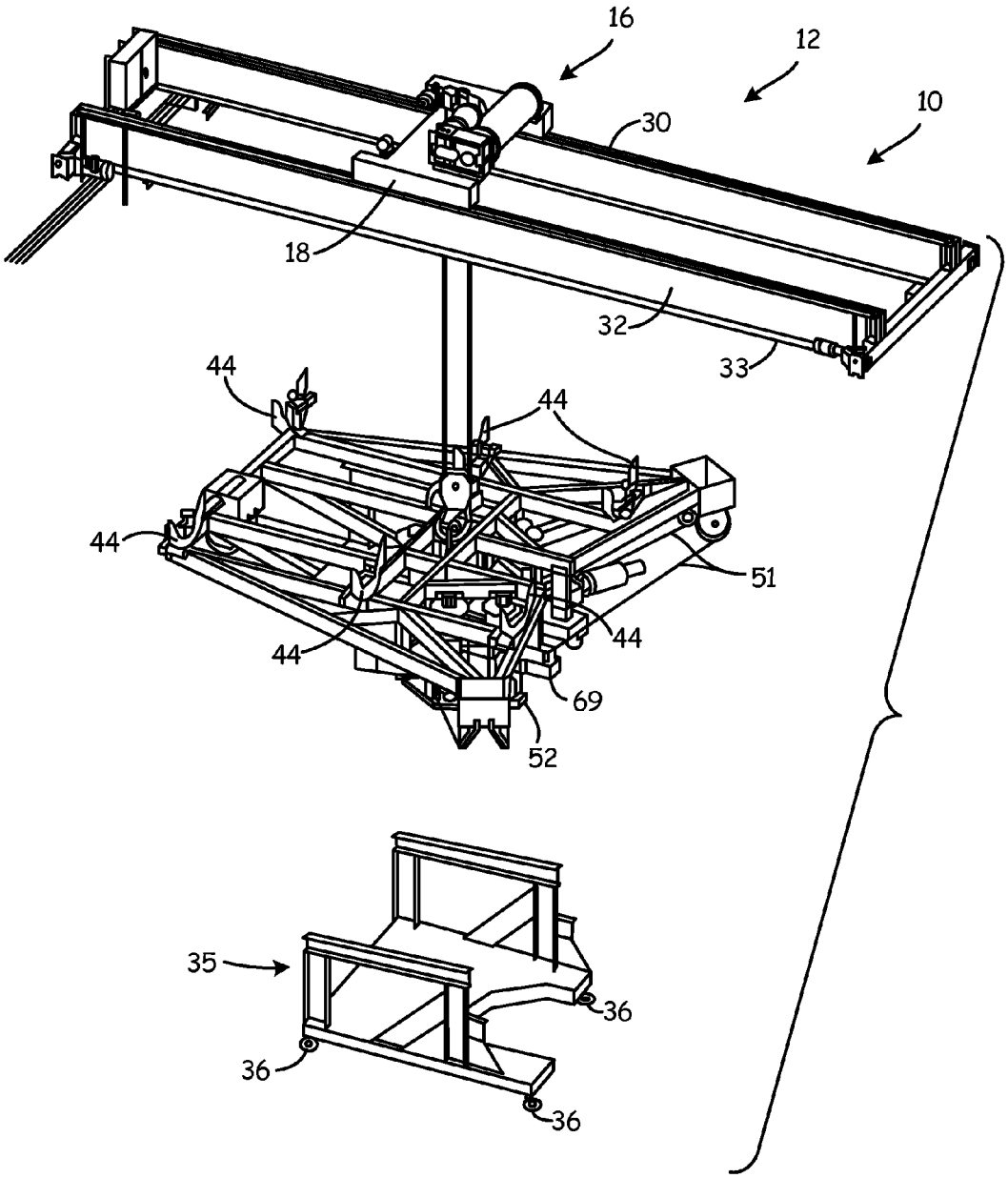
Figure 10:
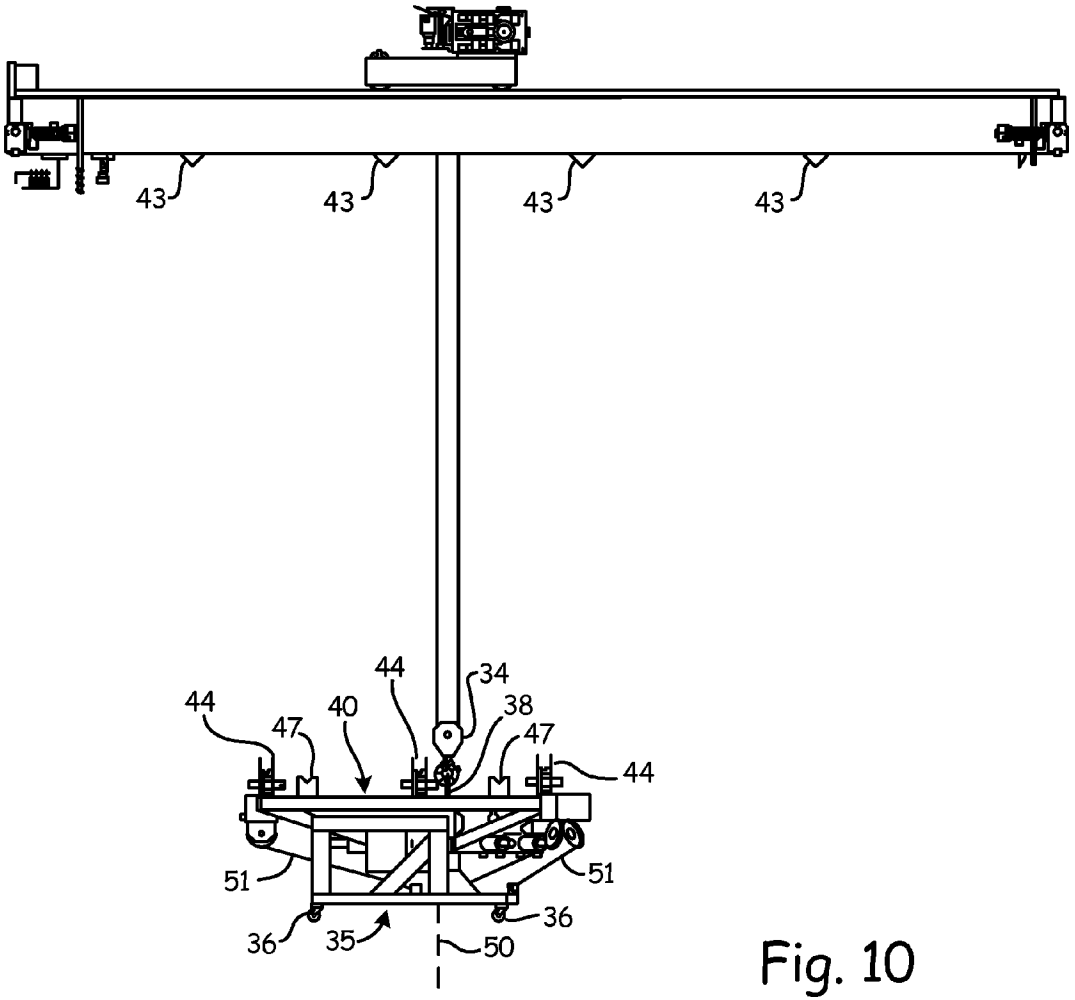
FIG. 10 is an elevational view of the crane system of FIG. 1.

FIGS. 4 and 10 illustrates attachment of the carrying hook 34 to the positioner 24. In the illustrated embodiment, the positioner 24 includes a standoff 38 on a frame 40 to form a lift point. For example, the standoff 38 can include a suitable aperture for receiving the carrying hook 34; however, it should be understood that this is but one embodiment for illustrating connection of the hoist 16 to the positioner 24 and as appreciated by those skilled in the art other forms of lift points and/or attachment mechanisms can be used.

It should be also noted that, if desired, the positioner 24 can be stored in a selected location on the bridge 12, for example, at one end when not in use. When it is desired to use the positioner 24, the hoist 16 can move the positioner 24 along the bridge 12 to the selected location being connected to the hoist 34 by the carrying hook 34 or being connected to another portion of the hoist 16 such as upper platform 18 (and back to the storage location on the bridge 12), and if desired, without the positioner 24 ever being fully detached from the bridge 12.

Figure 6:
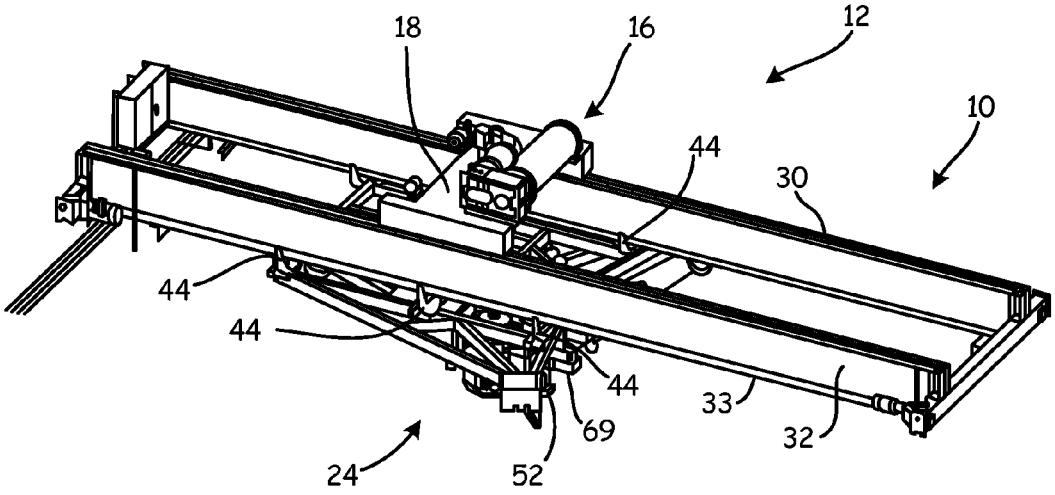
Figure 7:
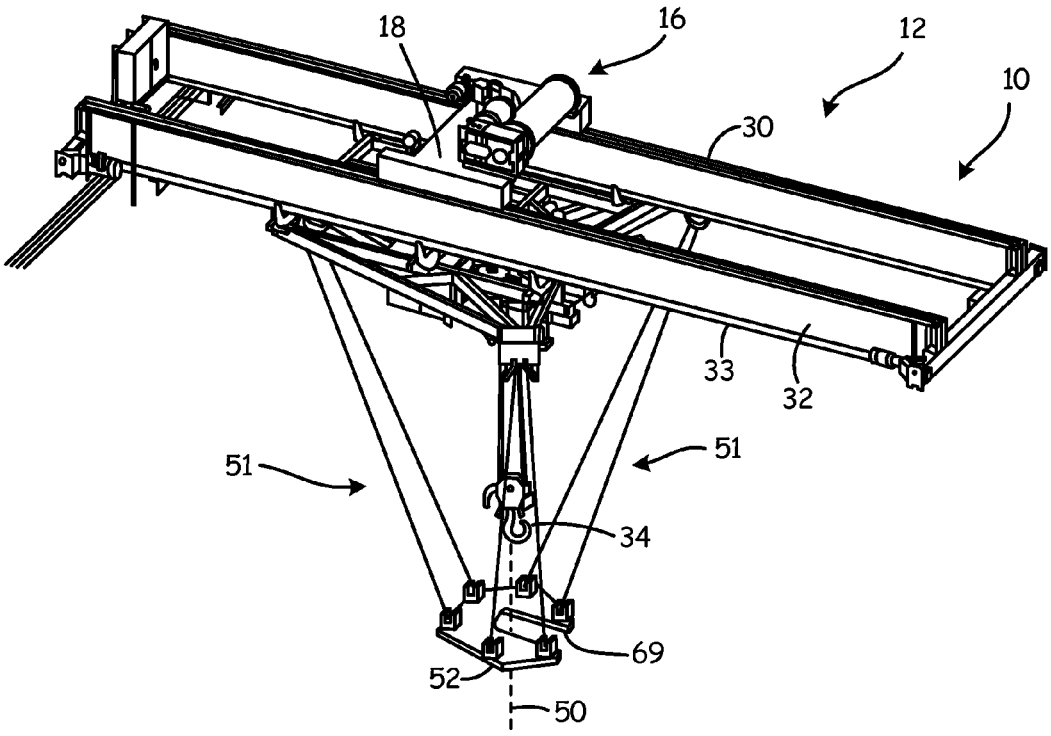
Figure 8:
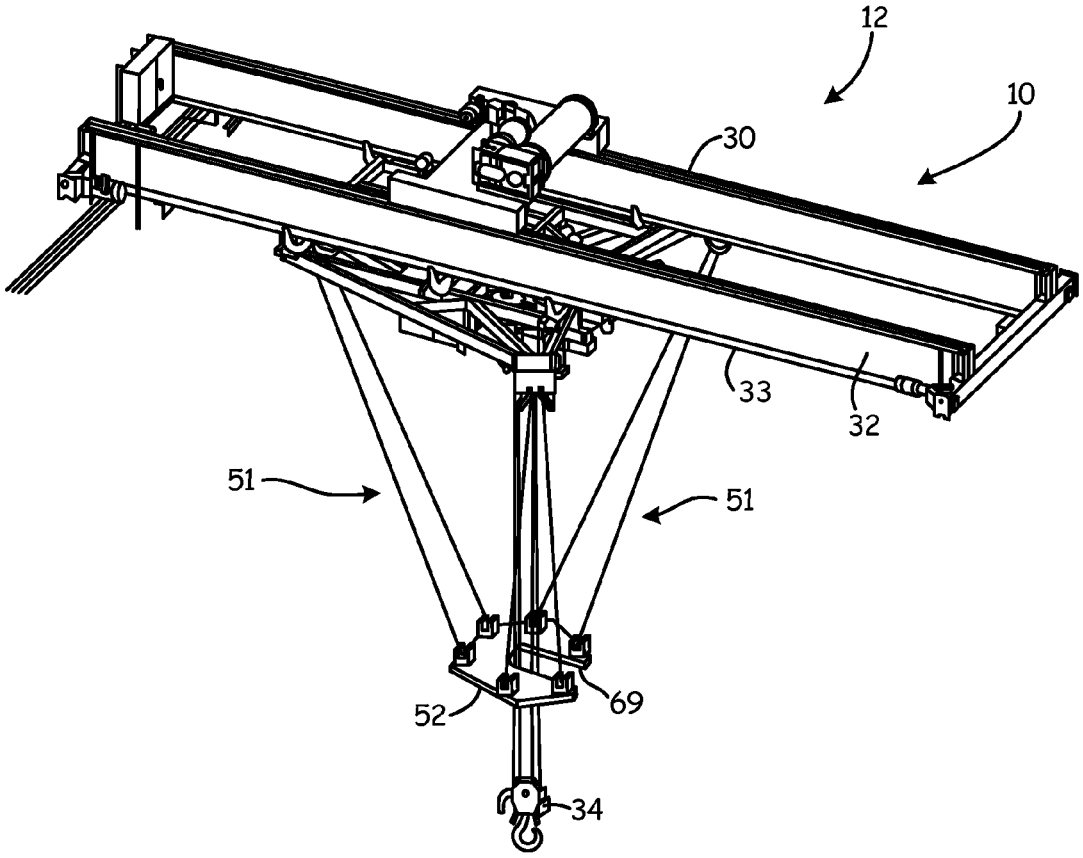
Figure 9:
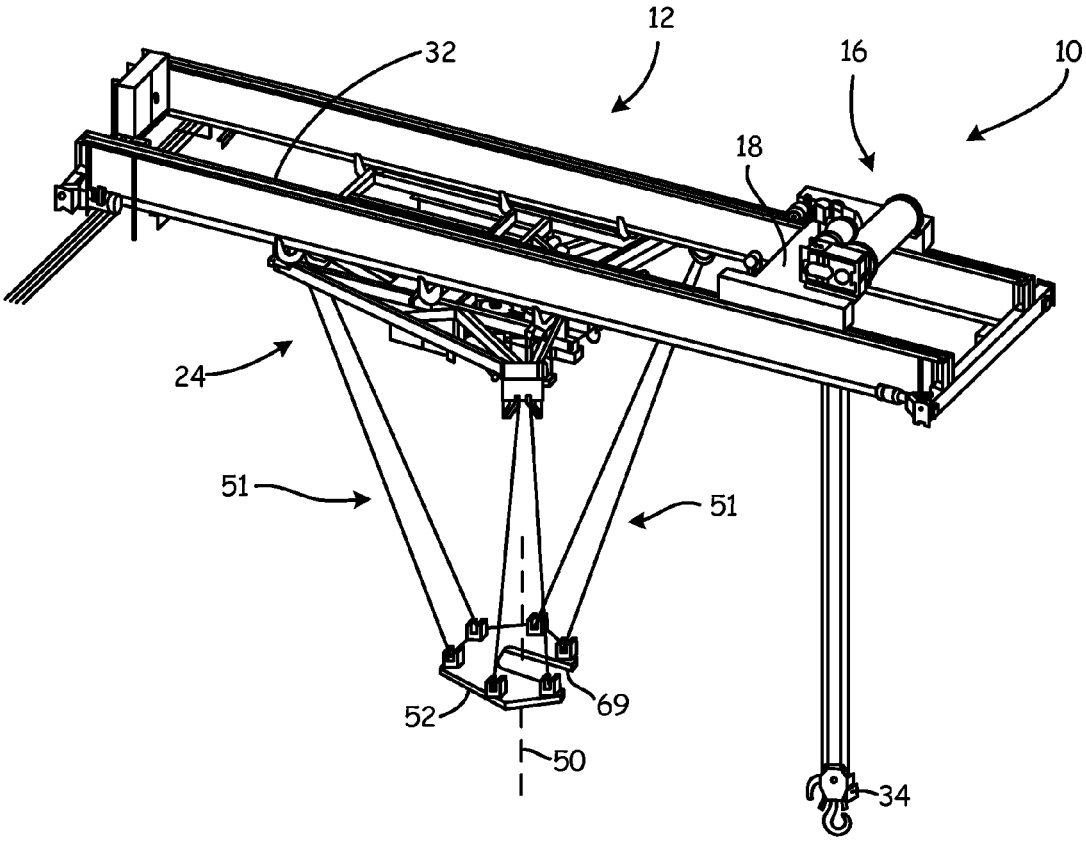

FIG. 6 illustrates attachment of the positioner 24 to the bridge 12 at a selected location. The positioner 24 and the bridge 12 include one or more locking devices 44 (FIG. 2) with complimentary elements so as to releasably secure the positioner 24 to the bridge 12. By way of example, each support member 30,32 of the bridge 12 can comprise an I-beam, the I-beam having horizontal flanges 33 formed on a lower surface thereof extending in opposite directions. In this embodiment, the positioner 12 includes a plurality of locking devices 44. Each locking device comprise a clamp that has elements that engage and clamp to the horizontal flanges 33 of the support members 30,32 and thus holds the positioner 12 in a fixed position. In the embodiment illustrated, the positioner 24 includes three spaced apart locking devices 44 for each of the support members 30,32. However, this is but one embodiment in that any desired number of locking devices can be used depending, for example, upon the application. Likewise, in yet another alternative embodiment, the locking device can comprise a movable member such as a rod or wedge with a complementary member, for example, an aperture or other form of receiver to secure the positioner 24 to the bridge 12.

Although illustrated wherein the bridge includes I-beam support members, this is but one embodiment. For instance, bridges can be formed as an elongated box section. In such cases, it may be necessary to include apertures and/or structures welded or otherwise joined to the bridge 12. Generally, the bridge 12 is of a shape that includes or is modified to include (such as on existing crane systems) locations capable of supporting the positioner 24 in a fixed position to which the positioner 24 is secured to.

In a further embodiment, the positioner 24 and the bridge 12 can have complimentary elements so as to align the positioner 24 and secure the positioner 24 in a predetermined location. Such aligning elements can be contacting or non-contacting. For instance, the positioner 24 can have standoffs or projections 43 extending from a surface of the bridge 12 wherein the positioner 24 includes a receiver 47 that receives the standoff or projection 43. In a further embodiment, a plurality of spaced apart complimentary aligning elements are provided on the bridge 12 and positioner 24 so as to ensure a desired orientation of the positioner 24 on the bridge 12. It should also be noted, the aligning members (as illustrated by projections 43) on the bridge 12 can be spaced apart along the bridge 12 so that the positioner 24 can be secured at any one of a number of different locations on the bridge 12. Non-contacting aligning members can take the form of positioner sensors that provide an output signal indicating that the positioner 24 is in a desired position. Likewise, a camera referencing a fixed scale can also be used.

Figure 11:
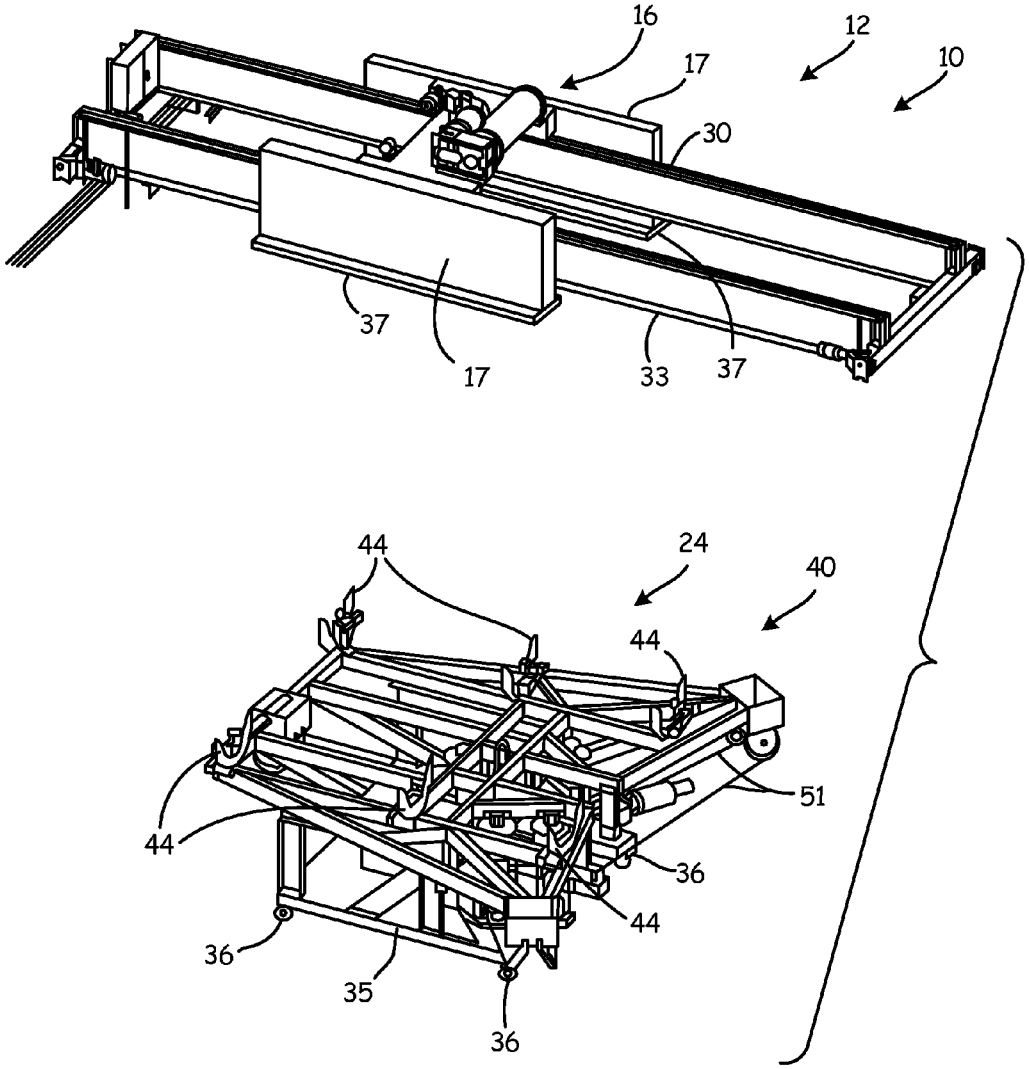
FIG. 11 is a perspective view of a second embodiment of a crane system.

FIG. 11 illustrates another embodiment where the positioner 24 is secured to the hoist 16 so as to move therewith on the bridge 12 when connected thereto. In this exemplary embodiment, the upper platform 18 includes support plates 17 to which the positioner 24 is selectively secured. In this illustrative embodiment, each of the support plates 17 have opposed horizontal flanges 37 formed on a lower surface thereof extending in opposite directions similar to the flanges 33 described above. Locking devices 44 clamp to the flanges 37 in the same manner, being suitably disposed on the positioner 24 to align with the flanges 37. Similarly, if desired, the positioner 24 can align to standoffs or projections (similar to projections 43) extending from a surface of the support plates 17 wherein the positioner 24 includes a receiver (similar to receiver 47) that receives the standoff or projection 43. In a further embodiment, a plurality of spaced apart complimentary aligning elements are provided on the support plates 17 and positioner 24 so as to ensure a desired orientation of the positioner 24 on the hoist 16. Non-contacting aligning members can take the form of positioner sensors that provide an output signal indicating that the positioner 24 is in a desired position. Likewise, a camera referencing a fixed scale can also be used.

It should be understood that the support plates 17 illustrated in FIG. 11 are merely exemplary. In another embodiment, the support plates 17 can be located between the rails of the bridge 12 rather than on the outside thereof. As appreciated by those skilled in the art, the support plate(s) of the hoist 16 to which the positioner 24 is selectively secured can take any number of forms. Likewise, the locking devices 44 can take any number of forms as discussed above. In addition, separate locking devices 44 can be provided to attach the positioner 24 selectively to either the upper platform 18 or the bridge 12, or the locking devices 44 can be selectively configured in a movable manner to engage the upper platform 18 or the bridge 12 as desired.

Referring now to aspects of the positioner 24, as stated earlier, the frame 40 includes a lift point 38 selectively engageable by the lifting member 34. Typically, the lift point 38 is disposed on the positioner 24 at or at least proximate to the center of gravity of the positioner 24. A reference axis 50 can be defined as extending downwardly, for instance, through the center of gravity. A plurality of hoists 55 each hoist 55 having at least one rope 51 where the ropes 51 extend downwardly and inwardly to the axis 50 from spaced apart locations about the frame 40. The ropes 51 are joined to a lower member 52 at spaced apart locations about the lower member 52. With this construction, the lower member 52 to at least some lateral forces and/or moments is obtained because the wire ropes 51 are kinematically constrained and where the stiffness of the lower member 52 is determined at least in part, by orientation of the ropes 51 relative to each other and the tensile elasticity of the ropes 51. The lower member 52 can be moved in a work envelope indicated by circle 58 as determined by the length of each of the wire ropes 51 suspending the lower member 52 from the frame 40. In the illustrative embodiment, six wire ropes 51 are used. Both the frame 40 and the lower member 52 each have three spaced apart locations where two wire ropes 51 are joined or substantially come together such that the wire ropes 51 at each location come from two different locations on the lower member 52/support frame 40. With the plurality of ropes so arranged the positioner 24 can pick up and lift offset loads since the positioner can resist overturning moments to some extent, if desired. The positioner of this type can take a number of different forms or include other features. Some exemplary embodiments of such a positioner are disclosed in WO 2011/123816, the content of which is hereby incorporated by reference in its entirety. Operation of the hoists of the positioner can be performed with a wireless or tethered communication.

Although not shown, the lower member 52 includes support(s), hook(s), fastener(s) and the like to connect the object thereto, the specific details of which are not pertinent to the present invention and vary depending upon the object.

Referring to FIG., the frame 40 includes frame members 63 that create at least an aperture 60 through which the lifting member 34 can extend through when the hoist 16 is above the positioner 24. In this manner, the hoist 16 can be used to pick up an object while the positioner 24 is in place.

In such situations, the lower member 52 is moved away, removed and/or includes a similar aperture such that the lifting member 34 can engage the object.

In yet a more advantageous embodiment, the frame members 63 define an upper channel 67 leading to the aperture 60 from an opening 68 at a location on an outer perimeter of the frame 40. The opening 68 of the channel 67 is aligned with linear movement of the rope of the hoist 16 as the platform 18 moves the hoist 16 along the bridge 12. The opening 68 thus allows the rope to enter the channel 67, while the channel 67 is of sufficient length to allow the rope to be positioned easily below the positioner 24 to pick up or release objects.

In yet a further advantageous embodiment, the lower member 52 also includes a channel 69 that serves the same purpose as the upper channel 67, that being allowing the rope to be moved linearly therein with movement of the hoist 16 on the bridge 12. As such, the channel 69 in the lower member 52 is aligned with the upper channel 67, each of which can have a width to accommodate the lifting member 34 if disposed therethrough.

By allowing the lifting member 34 and wire rope of the hoist 16 to extend through the positioner 24 and in particularly through the frame 40 having the channel 67 and the lower member 52 having the channel 69, objects can be picked up by the hoist 16 with movement of the bridge 12 upon the rails 14 and the platform 18 on the bridge 12 and then moved to be placed below the positioner 24. At which point, the hoist 16, if desired, can be detached from the object with the hook 34 and the wire rope pulled upwardly through the apertures of the lower platform 52 and the frame 40. It should be noted that the positioner 24 can be secured to the bridge 12 such that the channels 67,69 open in either direction with respect to being parallel to the bridge 12 to allow the rope to be moved therein.

Although the subject matter has been described in language specific to structural features and/or methodological acts, it is to be understood that the subject matter defined in the appended claims is not necessarily limited to the specific features or acts described above as has been determined by the courts. Rather, the specific features and acts described above are disclosed as example forms of implementing the claims.

What is claimed is:

1. A crane system comprising:

a pair of opposed rails;

a bridge spanning between and supported on the rails and movable thereon;

an upper platform movable longitudinally on the bridge;

a hoist mounted to the upper platform, the hoist having a rope and a lifting member disposed at a remote end of the rope; and a positioner releasably secured to one of the bridge or the upper platform in a first position, the positioner comprising:

a frame with a lift point selectively engageable by the lifting member to carry the frame below the lifting member when the positioner is released from the bridge or the upper platform and to lift the frame toward the bridge, the frame having a reference vertical axis extending through the frame;

a lower member;

a plurality of hoists each having at least one rope, the ropes extending downwardly and inwardly toward the reference vertical axis from spaced apart locations about the frame, the ropes being joined to the lower member at spaced apart locations about the lower member; and one or more locking devices configured to selectively secure the positioner to at least one of the bridge or the upper platform.

2. The crane system of claim 1 wherein the one or more locking devices are configured to completely detach the positioner from the bridge.

3. The crane system of claim 1 wherein the positioner and the bridge or upper platform include one or more aligning devices comprising a first element disposed on the bridge or upper platform and a second element on the frame that is alignable with the first element.

4. The crane system of claim 3 and comprising a plurality of spaced apart first elements disposed on the bridge or upper platform each alignable with the second element on the frame.

5. The crane system of claim 4 wherein the first element and the second element engage each other.

6. The crane system of claim 4 wherein each of the first elements is engageable with the second element.

7. The crane system of claim 1 and a fixture configured to hold the positioner in a position such that the lifting member of the hoist engages the lift point on the frame.

8. The crane system of claim 1 wherein the lift point is at or proximate a center of gravity for the positioner, and wherein the lift member is configured to be moved away from the center of gravity to allow the lift member to extend downwardly through a recess in the frame of the positioner.

9. The crane system of claim 8 wherein frame members of the frame define an upper channel leading to the recess from an opening at a location on an outer perimeter of the frame, the opening of the upper channel being aligned with movement of the rope.

10. The crane system of claim 9 wherein the lower member includes a lower channel that is aligned with the upper channel.

11. The crane system of claim 10 wherein the upper channel and the lower channel comprise an area sufficient to allow the lifting member to extend therethough.

12. The crane system of claim 1 wherein each of said one or more locking devices comprise a clamp.

13. The crane system of claim 1 wherein the bridge or upper platform includes a lower horizontal flange to which each locking device engages.

14. The crane system of claim 13 wherein the lower horizontal flange extends continuously along the longitudinal length of the bridge.

15. The crane system of claim 1 wherein the positioner is selectively securable and freely detachable from the at least one of the bridge or the upper platform and wherein the one or more locking devices are configured to fixedly and removably secure the frame.

16. The crane system of claim 1 wherein the plurality of hoists include at least three hoists.

17. A crane system comprising:

a pair of opposed rails;

a bridge spanning between and supported on the rails and movable thereon;

an upper platform movable longitudinally on the bridge;

a hoist mounted to the upper platform, the hoist having a rope and a lifting member disposed at a remote end of the rope; and a positioner releasably secured to one of the bridge or the upper platform in a first position, the positioner comprising:

a frame with a lift point selectively engageable by the lifting member, wherein the positioner is carried only by the lift member using the lift point on the frame when when the positioner is released from the bridge or the upper platform, the frame having a reference vertical axis extending through the frame;

a lower member;

at least three hoists each hoist having a rope, the ropes equally angularly spaced about the reference vertical axis and extending downwardly and inwardly at an inclined angle toward the reference vertical axis from spaced apart locations about the frame, the ropes being joined to the lower member at spaced apart locations about the lower member; and one or more locking devices configured to selectively secure the positioner to at least one of the bridge or the upper platform.

18. The crane system of claim 17 wherein the one or more locking devices are configured to selectively secure the positioner to the bridge.

19. The crane system of claim 18 wherein the one or more locking devices carried by the positioner.

20. The crane system of claim 17 wherein the one or more locking devices are configured to selectively secure the positioner to the upper platform.

21. The crane system of claim 20 wherein the one or more locking devices carried by the positioner.

* * * * *